United States Patent [19]

Imai

[11] Patent Number: 4,804,283

[45] Date of Patent: Feb. 14, 1989

[54] RIBBON FEED DEVICE INCLUDING TENSIONING CONTROL MEANS

[75] Inventor: Minoru Imai, Ohhito, Japan

[73] Assignee: Tokyo Electric Co., Ltd., Tokyo, Japan

[21] Appl. No.: 115,051

[22] Filed: Oct. 30, 1987

[30] Foreign Application Priority Data

Nov. 5, 1986 [JP] Japan ..... 61-170082[U]

[51] Int. Cl.[4] ..... B41J 33/52

[52] U.S. Cl. ..... 400/234; 400/211; 400/236.1; 400/696; 400/697.1

[58] Field of Search ..... 400/207, 208, 208.1, 400/211, 234, 236.1, 695, 696, 697, 697.1

[56] References Cited

U.S. PATENT DOCUMENTS

| | | | |
|---|---|---|---|
| 2,886,162 | 5/1959 | Eissfeldt et al. | 400/234 X |
| 3,724,633 | 4/1973 | Korb et al. | 400/234 X |
| 4,247,210 | 1/1981 | Kacmarcik et al. | 400/236.1 |
| 4,411,542 | 10/1983 | Wenderoth et al. | 400/697.1 |
| 4,462,707 | 7/1984 | Falconieri | 400/208 X |

FOREIGN PATENT DOCUMENTS

| | | | |
|---|---|---|---|
| 0089388 | 5/1985 | Japan | 400/236.1 |
| 0124280 | 7/1985 | Japan | 400/234 |

OTHER PUBLICATIONS

IBM Technical Disclosure Bulletin, "Erase Ribbon Lift and Advancing Mechanism", Mathews, vol. 19, No. 7, Dec. 1976, pp. 2393–2394.

*Primary Examiner*—Ernest T. Wright, Jr.
*Attorney, Agent, or Firm*—Oblon, Fisher, Spivak, McClelland & Maier

[57] ABSTRACT

The invention provides a ribbon feed device wherein a ribbon take-up mechanism located on a ribbon frame which is mounted for up and down pivotal motion on a carrier and carrying thereon an elongated ribbon along a platen takes up the ribbon in response to upward pivotal motion of the ribbon frame in order to effect printing of a character or erasing of a printed character. During downward pivotal motion of the ribbon frame, the path of the ribbon is bent by a pressing member secured to the carrier to remove possible slacking of the ribbon which may appear along a ribbon feeding route upon printing or erasing operation so as to apply suitable tension to the ribbon.

3 Claims, 5 Drawing Sheets

RIBBON FEED DEVICE INCLUDING TENSIONING CONTROL MEANS

FIELD OF THE INVENTION

This invention relates to a ribbon feed device for use with a printer, and more particularly to a ribbon feed device of a structure wherein a ribbon positioned below an impact position is lifted to the impact position just before impact for printing.

RELATED ART STATEMENT

An exemplary one of conventional ribbon feed devices of the type mentioned is shown in FIGS. 1 and 2. Referring to FIGS. 1 and 2, the ribbon feed device shown includes a platen 2 mounted for rotation around an axis thereof. A print hammer 3 is mounted for pivotal motion around a pivot shaft 4 to strike against the platen 2 with a daisy wheel 1 interposed therebetween. The daisy wheel 1 and the print hammer 3 and driving mechanisms for them are carried on a carrier (not shown) which is mounted for movement in a direction parallel to the axis of the platen 2. A ribbon frame 6 for holding a ribbon 5 along the platen 2 is also mounted for pivotal motion around a pivot shaft 7 on the carrier. Here, since the pivot shaft 7 is located far from the platen 2, the ribbon frame 6 makes an up and down motion at a position near the platen 2.

A ribbon take-up shaft 8 for successively taking up the ribbon 5 thereon and a ratchet wheel 9 are mounted for integral rotation on one side of the ribbon frame 6. A detent pawl 10 for engaging with the ratchet wheel 9 to prevent rotation of the ratchet wheel 9 in a reverse direction (clockwise direction in FIGS. 1 and 2) is also mounted on the ribbon frame 6. An engaging member 12 is secured to the carrier and has a resilient portion 11 for resiliently engaging with the ratchet wheel 9.

A roller 13 is mounted for rotation at a location on the side of the ribbon frame 6 spaced away from the pivot shaft 7. A grooved cam 14 and a driving mechanism therefor (not shown) are carried on the carrier, and as the grooved cam 14 is rotated, it moves the roller 13 up and down.

A paper guide 15 is secured to the carrier and located in front of the platen 2 for guiding record paper (not shown) wrapped around the platen 2 separately from the ribbon 5. An opening 16 is formed at a location of the paper guide 15 opposing to the print hammer 3.

It is to be noted that a rotatable ribbon supply shaft (not shown) having a roll of the ribbon 5 carried thereon and a brake means (not shown) for applying a braking force to the ribbon supply shaft are located on a side of the ribbon frame 6 opposite to the side on which the ribbon take-up shaft 8 and some other elements are located.

With the ribbon feed device of such a structure as described above, as the print hammer 3 is pivoted to strike a character type on the daisy wheel 1 against the platen 2, erasing of a printed character is effected where the ribbon 5 is a correction ribbon, but printing of a character is effected where the ribbon 5 is a print ribbon. In particular, before operation for such erasing or printing, the ribbon frame 6 is pivoted upwardly from a position shown in FIG. 1 to another position shown in FIG. 2. Such an upward pivotal motion of the ribbon frame 6 is effected by rotation of the grooved cam 14 to move the roller 13 upwardly. In this instance, since the ratchet wheel 9 is latched by the engaging member 12 during such upward pivotal motion of the ribbon frame 6, the ratchet wheel 9 is rotated in a counterclockwise direction as the ribbon frame 6 is pivoted. Upon rotation of the ratchet wheel 9, the ribbon 5 is taken up onto the ribbon take-up shaft 8. Then, at an uppermost position of the ribbon frame 6, the print hammer 3 is actuated to effect erasing or printing.

Here, the reason why the ribbon 5 is taken up upon upward pivotal motion of the ribbon frame 6 is that it is desired to take up the ribbon 5 just before erasing or printing operation. More particularly, if the ribbon 5 is taken up on the contrary upon downward pivotal motion of the ribbon frame 6, there is the possibility that a considerable interval of time may pass until subsequent erasing or printing operation is effected after the ribbon 5 has been taken up. Consequently, a portion of the ribbon 5 which is to be used for subsequent erasing or printing is held exposed outside until then, which may result in a disadvantage that the ribbon 5 may be soiled or the like. To the contrary, with the construction wherein the ribbon 5 is taken up upon upward pivotal motion of the ribbon frame 6, a new portion of the ribbon 5 which has not been exposed outside is brought to the impact position just before erasing or printing operation. Accordingly, a new clean portion of the ribbon 5 is always provided for erasing or printing.

Now, a problem of the prior art arrangement will be described. If the print hammer 3 is rendered operative, part of the ribbon 5 is projected through the opening 16 of the paper guide 15 toward the platen 2. Thereupon, the ribbon 5 is supplied by an increment corresponding to such projection thereof from the ribbon supply shaft side. Accordingly, after the print hammer 3 is subsequently returned away from the platen 2, such increment of the ribbon 5 will yield slackening in a section of the ribbon 5 along a feeding route from the supply side to the take-up side in which the ribbon 5 must naturally be in a taut condition. Accordingly, it is a problem that if the ribbon frame 6 is pivoted down in such a condition, then the ribbon 5 may partially be caught by the paper guide 15 or some other elements. Objects of the Invention It is a first object of the present invention to provide a ribbon feed device wherein a ribbon is prevented from being caught by any structural element during downward movement of the ribbon from a lifted position.

It is a second object of the present invention to provide a ribbon feed device which has such an advantage as described just above but is not complicated in structure.

SUMMARY OF THE INVENTION

In order to attain the objects, according to the present invention, a ribbon feed device comprises a ribbon frame mounted for pivotal motion in an up and down direction on a carrier and carrying thereon an elongated ribbon along a platen, a ribbon take-up mechanism mounted on the ribbon frame for taking up a ribbon in response to upward pivotal motion of the ribbon frame, and a pressing member mounted on the carrier for bending the path of the ribbon in response to downward pivotal motion of the ribbon frame. Accordingly, even if some slackening appears at part of the ribbon when printing or erasing operation is effected in the upwardly pivoted position of the ribbon frame, the pressing member bends, when the ribbon frame is pivoted downwardly, the path of the ribbon to apply suitable tension to the ribbon, thereby absorbing such slackening of the ribbon. Accordingly, such a disadvantage that the ribbon which is slackened upon downward pivotal motion of the ribbon frame is caught by some other structural element can be prevented.

DESCRIPTION OF THE PREFERRED EMBODIMENT

Figure 1:
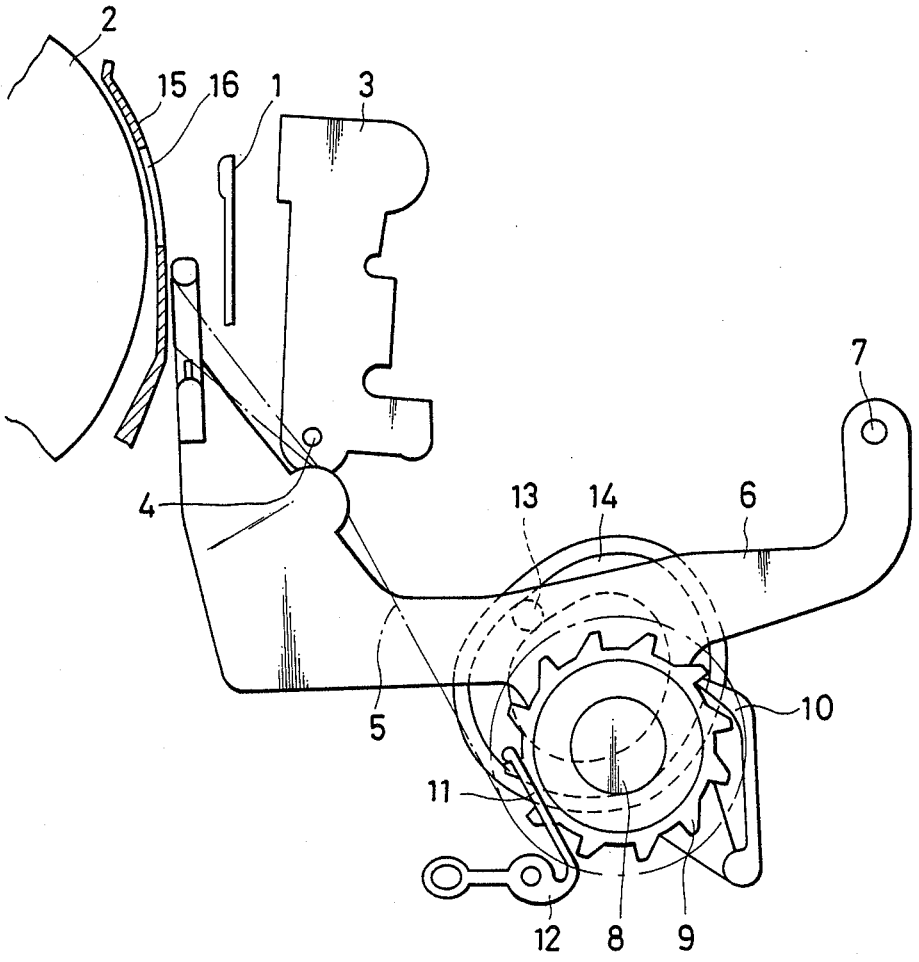
FIG. 1 PRIOR ART
FIG. 1 is a side elevational view of a take-up side of an exemplary one of conventional ribbon feed devices when a ribbon is in its lowered position.
Figure 2:
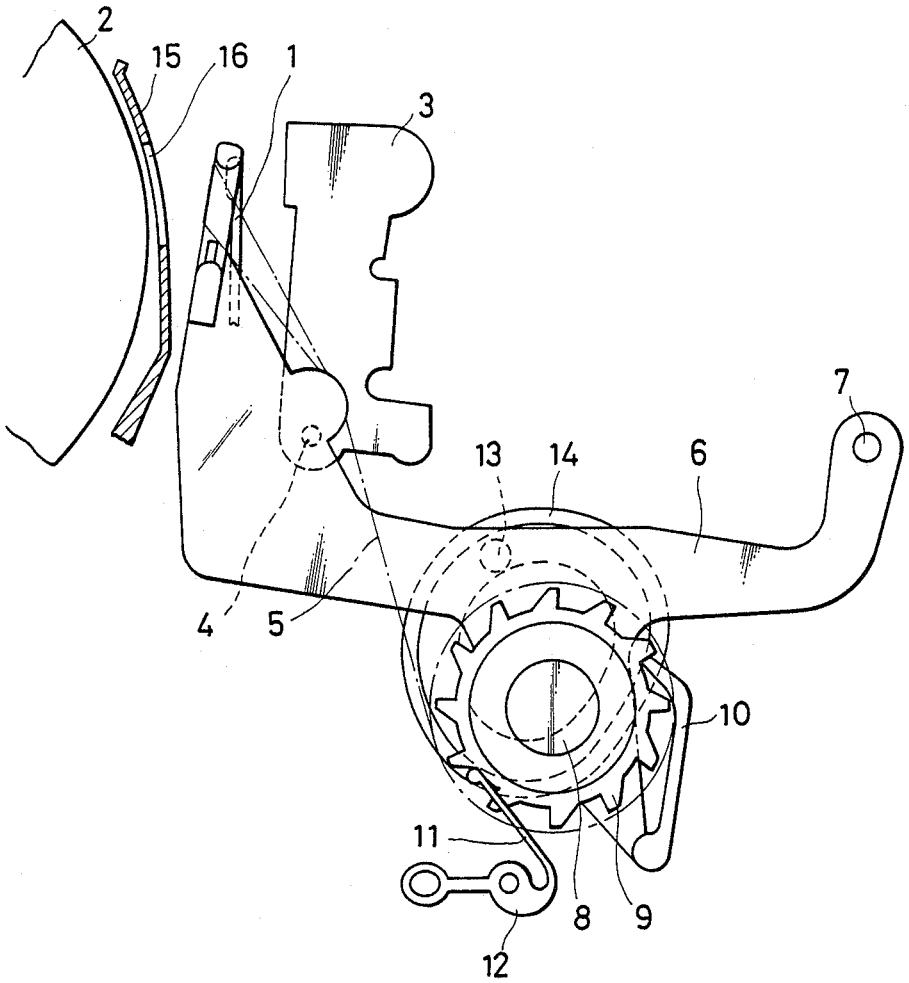
FIG. 2 PRIOR ART
FIG. 2 is a side elevational view of the take-up side of the conventional ribbon feed device of FIG. 1 when the ribbon is in its lifted position.
Figure 3:
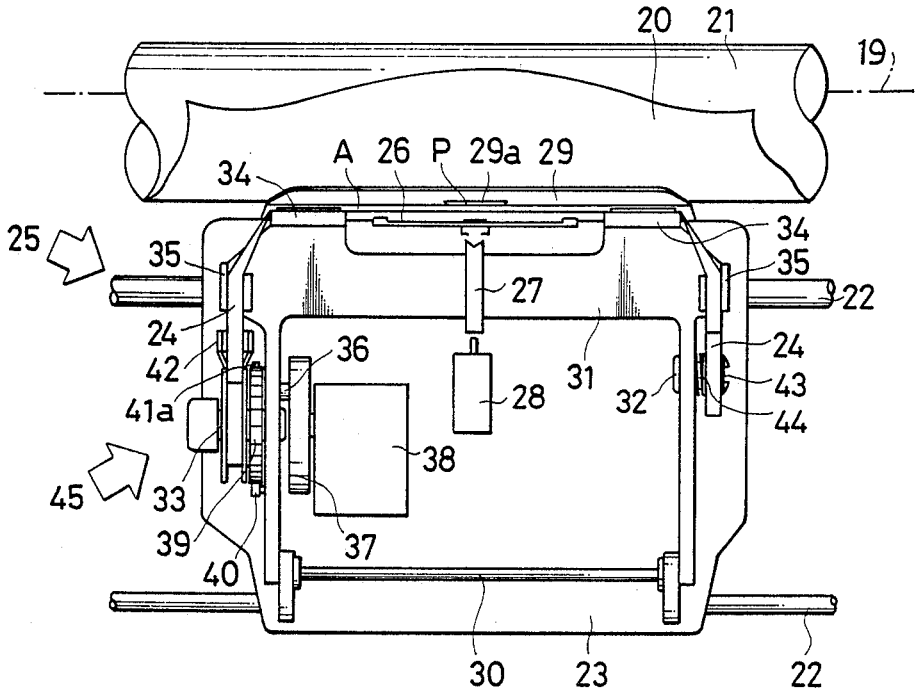
FIG. 3 is a plan view of an entire ribbon feed device showing a preferred embodiment of the present invention.

A preferred embodiment of the present invention will be described with reference to FIGS. 3 to 5. The ribbon feed device shown includes a platen 21 mounted for rotation around an axis 19 and having record paper 20 wrapped therearound. A pair of guide shafts 22 extend in a direction parallel to the axis 19 of the platen 21, and a carrier 23 is mounted for sliding movement on the guide shafts 22. The carrier 23 carries thereon a ribbon feed mechanism (not shown) for feeding a print ribbon (not shown) and another ribbon feed mechanism 25 for feeding a correction ribbon 24. The correction ribbon 24 is provided for erasing of a printed character and has an adhesive layer on one face thereof. In order to erase a printed character using such a correction ribbon 24, generally the same character is printed in an overlapping relationship on the printed character, whereupon ink of the printed character is attracted by and transferred to the adhesive face of the correction ribbon 24.

The carrier 23 further carries thereon a daisy wheel 26 and a driving mechanism (not shown) for driving the daisy wheel 26. A print hammer 27 is also carried on the carrier 23 for striking a selected one of character types of the daisy wheel 26 against the platen 21 at a predetermined print position P. Here, the print hammer 27 is mounted for pivotal motion around a hammer pivot shaft 27*a* on the carrier 23 and is connected so that it may receive a driving force from a solenoid 28 located on the carrier 23. Further, a paper guide 29 is secured at a location of the carrier 23 opposing to the platen 21 with a very small gap left from the platen 21 via the record paper 20. The paper guide 29 has an opening 29*a* formed at a location thereof opposing to the print position P at which impact of the daisy wheel 26 upon the platen 21 occurs.

Now, the ribbon feed mechanism 25 will be described. A support shaft 30 having a center axis 30' is secured to an end portion of the carrier 23 remote from the platen 21 and extends in a direction parallel to the axis 19 of the platen 21. A ribbon frame 31 is mounted for pivotal motion on the support shaft 30 and is so shaped and positioned that a central portion thereof is located near and extends along the platen 21. The ribbon frame 31 has mounted for rotation on one side thereof a ribbon supply shaft 32 on which a ribbon supply member 43 on which the correction ribbon 24 is held in a wrapped condition is removably mounted. On the other side of the ribbon frame 31, a ribbon take-up shaft 33 for taking up the correction ribbon 24 is mounted.

Adjacent a ribbon feeding route A from the ribbon supply shaft 32 to the ribbon take-up shaft 33, a pair of guide plates 34 for holding the correction ribbon 24 along the platen 21 are formed in an integral relationship on the ribbon frame 31. A pair of ribbon guides 35 for twisting the correction ribbon 24 to regulate its orientation in the ribbon feeding route A are also formed in an integral relationship on the ribbon frame 31. A coil spring 44 is interposed between the ribbon supply member 43 and an opposing side wall of the ribbon frame 31 for applying a resisting force against free rotation of the ribbon take-up shaft 33.

A roller 36 is mounted for rotation at a location on the ribbon frame 31 spaced from the center axis 30' of the support shaft 30 for the ribbon frame 31. A grooved cam 37 for moving the roller 36 as a cam follower up and down is mounted on the carrier 23. A driving device 38 for providing a driving force to the grooved cam 37 is also located on the carrier 23. Here, the several parts are designed such that the correction ribbon 24 may be positioned at the same vertical position with the print position P when the roller 36 is moved up to its most lifted position within one cycle of operation—that is, when the ribbon frame 31 is pivoted to its uppermost position. It is to be noted that FIG. 4 shows the ribbon frame 31 in the lowermost pivoted position, while FIG. 5 shows the ribbon frame 31 in the uppermost pivoted position.

A ratchet wheel 39 is secured in a coaxial relationship to the ribbon take-up shaft 33. A detent pawl 40 is mounted at an end thereof for pivotal motion on the ribbon frame 31 and has the other end thereof located for engagement with the ratchet wheel 39 to hold the ratchet wheel 39 from rotation in one direction (clockwise direction in FIGS. 4 and 5) while allowing rotation of the ratchet wheel 39 in the other direction (counterclockwise direction in FIGS. 4 and 5). The direction in which the ratchet wheel 39 is allowed to rotate corresponds to the direction in which the correction ribbon 24 is taken up by the ribbon take-up shaft 33. An engaging member 41 is fixedly mounted on the carrier 23 and has a resilient portion 41a formed thereon for resiliently engaging with the ratchet wheel 39. The resilient portion 41a of the engaging member 41 is engaged with the ratchet wheel 39 only when the ribbon frame 31 is at its downwardly pivoted position, and when the ribbon frame 31 is pivoted downwardly from its upwardly pivoted position, the resilient portion 41a of the engaging member 41 is yieldably deformed due to its resiliency by a tooth of the ratchet wheel 39 to slip over an outer periphery of the tooth of the ratchet wheel 39.

Thus, the ribbon take-up shaft 33, the ratchet wheel 39, and the engaging member 41 constitute a ribbon take-up mechanism 45 for taking up the correction ribbon 24 in response to upward pivotal motion of the ribbon frame 31.

Further, a pressing member 42 is formed in an integral relationship on the engaging member 41 for engaging with the correction ribbon 24 in the ribbon feeding route A to bend the path of the correction ribbon 24. The pressing member 42 is located specifically such that it is engaged with the correction ribbon 24 between ribbon take-up shaft 33 and the ribbon guide 35 and such that the bent angle of the path of the correction ribbon 24 increases as the ribbon frame 31 is lowered.

Figure 4:
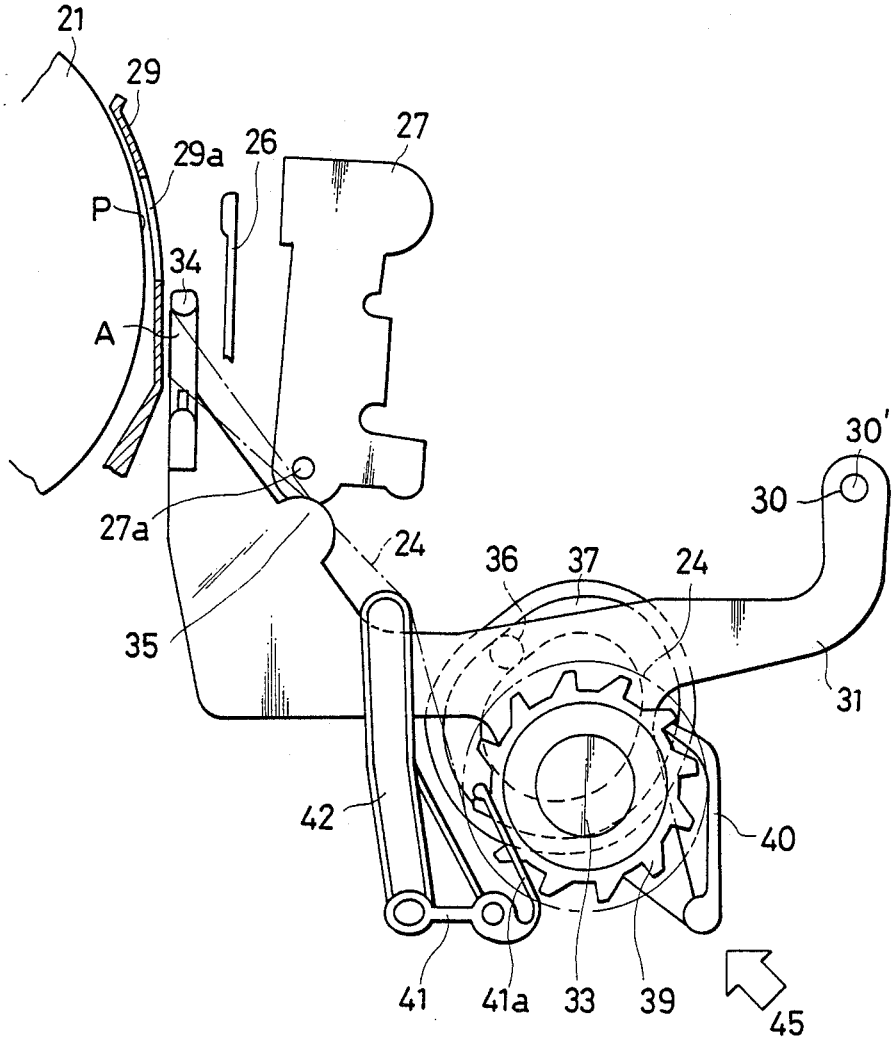
FIG. 4 is a side elevational view of a take-up side of the ribbon feed device of FIG. 3 when a ribbon is in its lowered position.
Figure 5:
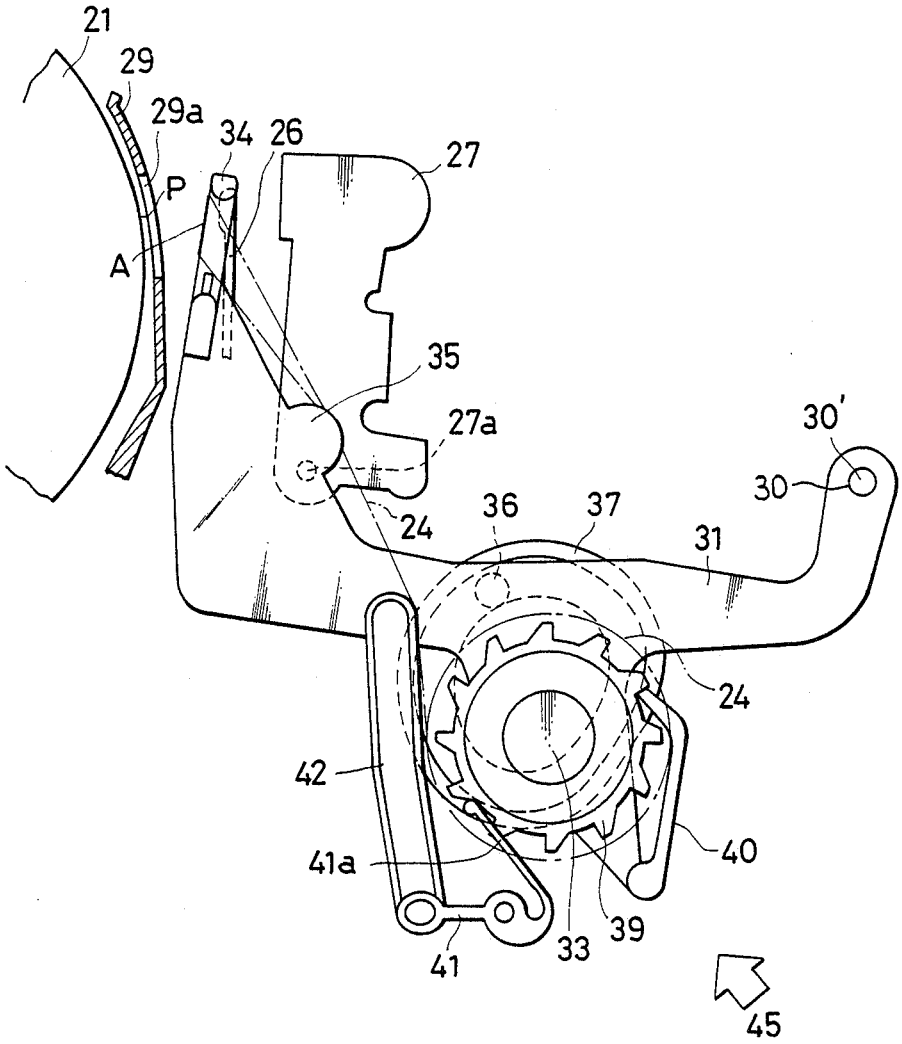
FIG. 5 is a side elevational view of the take-up side of the ribbon feed device of FIG. 3 when the ribbon is in its lifted position.

With the ribbon feed device having such a construction as described above, when correction printing (that is, erasing), is to be effected, the ribbon frame 31 is pivoted around the support shaft 30 from the lowermost pivoted position shown in FIG. 4 to the uppermost pivoted position shown in FIG. 5. Such upward pivotal motion of the ribbon frame 31 is effected by rotation of the grooved cam 37 by a driving force from the driving device 38 to lift the cam follower roller 36. Upon such upward pivotal motion of the ribbon frame 31, the ratchet wheel 39 is engaged with the resilient portion 41a of the engaging member 41 and held from upward movement by the latter. Consequently, the ratchet wheel 39 is rotated by the engaging member 41 as the ribbon frame 31 is pivoted upwardly. As the ratchet wheel 39 is rotated, the ribbon take-up shaft 33 is rotated against the frictional resistance provided by the coil spring 44 to take up the correction ribbon 24 thereon. Then at the upwardly pivoted position of the ribbon frame 31, the print hammer 37 is actuated by the solenoid 28 to strike a selected one of the character types on the daisy wheel 26 against the platen 21 via the correction ribbon 24, thereby erasing the printed character. After completion of such erasing operation, the ribbon frame 31 is returned rapidly to the lowermost pivoted position.

Meanwhile, at an instant when the selected character type of the daisy wheel 26 is struck against the platen 21, the correction ribbon 24 is partially moved out of the normal ribbon feeding route A and thus projected through the opening 29*a* of the paper guide 29 toward the platen 21. Consequently, the correction ribbon 24 is drawn out by an amount corresponding to such projection from the ribbon supply shaft 32. Such a drawn out increment of the correction ribbon 24 may cause some slackening of the correction ribbon 24 in the ribbon feeding route A in which the correction ribbon 24 must be in a taut condition. However, such possible slackening of the correction ribbon 24 is removed by the pressing member 42 as the ribbon frame 31 is pivoted downwardly. This is because the bent angle of the correction ribbon 24 by the pressing member 42 is set so as to gradually increase as the ribbon frame 31 is pivoted downwardly. Here, it naturally is a premise that the distance on a straight line from the guide plate 34 to the ribbon take-up shaft 33 presents no change while the ribbon frame 31 is pivoted downwardly. Consequently, tension is applied to the ribbon 24, and accordingly any possible trouble when the ribbon frame 31 is pivoted downwardly with the correction ribbon 24 left in a slackened condition is eliminated. One of such troubles is that the correction ribbon 24 is partially caught by the paper guide 29.

It is to be noted that, only at an instant of impact by a character type of the daisy wheel 26 but also when the pressing member 42 bends the ribbon path A upon downward pivotal motion of the ribbon frame 31, when the correction ribbon 24 is drawn out from the ribbon supply shaft 32, the ribbon supply shaft 32 will not be rotated inadvertently by a force of inertia of itself. This is because the ribbon supply shaft 32 is under frictional resistance against rotation in the rotating direction caused by the coil spring 44. Accordingly, particularly when the correction ribbon 24 is drawn out from the ribbon supply shaft 32 as the pressing member 42 bends the ribbon feeding path A, the correction ribbon 24 will not be slackened at all, and accordingly the correction ribbon 24 is maintained under fixed tension along the ribbon feeding route A thereof.

In addition, according to the present embodiment, only provision of the pressing member 42 at such a location wherein a portion of the correction ribbon 24 in the ribbon feeding route A is bent by the pressing member 42 upon downward pivotal motion of the ribbon frame 31 is required. Accordingly, the present embodiment does not present a disadvantage of complication in structure of the ribbon feeding device.

It is to be noted that, while in the embodiment described above, the present invention is applied to a ribbon feed device for feeding the correction ribbon 24 for erasing of a character, naturally it can be applied also to a ribbon feed device for a printing mechanism in which a print ribbon is used. Further, the ribbon feed device of the embodiment may have a construction wherein the ribbon 24 does not at all contact with the pressing member 42 when the ribbon frame 31 is pivoted upwardly.

What is claimed is:

1. A printer comprising:

(a) a platen having an axis and a peripheral surface;

(b) a carrier mounted for reciprocal movement in a direction parallel to the axis of said platen;

(c) a ribbon frame mounted on said carrier for pivotal motion about an axis parallel to the axis of said platen back and forth between a first position and a second position;

(d) a ribbon feed mechanism mounted on said ribbon frame;

(e) a ribbon take-up mechanism mounted on said ribbon frame, said ribbon take-up mechanism comprising:

(i) a ribbon take-up shaft mounted for rotation on said ribbon frame;

(ii) a ratchet wheel fixedly mounted on said ribbon take-up shaft for integral rotation with said ribbon take-up shaft; and (iii) an engaging member mounted on said carrier in position to resiliently engage said ratchet wheel and to rotate said ratchet wheel and said ribbon take-up shaft when said ribbon frame is pivoted from its second position to its first position;

(f) a plurality of guides mounted on said ribbon frame in position to guide a ribbon in a feeding route from said ribbon feed mechanism to said ribbon take-up mechanism, the feeding route including a first portion in which the ribbon is parallel to and closely spaced from the peripheral surface of said platen when said ribbon frame is in its first position, a second portion leading from said ribbon feed mechanism to the first portion, and a third portion leading from the first portion to said ribbon take-up mechanism;

(g) a printing mechanism positioned to strike the ribbon at a segment of the first portion of the feeding route when said ribbon frame is in its first position, thereby forcing the segment of the first portion of the ribbon towards said platen, drawing a length of the ribbon out of said ribbon feed mechanism, and causing a slack in the ribbon; and (h) a pressing member mounted on said carrier in position to press against the ribbon in one of the second and third portions of the feeding route as said ribbon frame pivots from its first position to its second position so as to take-up the slack in the ribbon caused by said printing mechanism while said ribbon frame was in its first position, said pressing member being integral with said engaging member.

2. A printer as recited in claim 1 wherein said pressing member is positioned to press against the ribbon in the third portion of the feeding route.

3. A printer as recited in claim 1 wherein said ribbon take-up mechanism further comprises a detent pawl mounted on said ribbon frame in position to prevent rotation of said ratchet wheel in one direction.

* * * * *